US009456677B2

(12) United States Patent
Künz

(10) Patent No.: US 9,456,677 B2
(45) Date of Patent: Oct. 4, 2016

(54) PLASTIC CONTAINER FOR A ROLL-ON DEODORANT

(71) Applicant: ALPLA Werke Alwin Lehner GmbH & Co. KG, Hard (AT)

(72) Inventor: Johann Künz, Hard (AT)

(73) Assignee: ALPLA WERKE ALWIN LEHNER GMBH & CO. KG, Hard (AT)

( * ) Notice: Subject to any disclaimer, the term of this patent is extended or adjusted under 35 U.S.C. 154(b) by 132 days.

(21) Appl. No.: 14/329,103

(22) Filed: Jul. 11, 2014

(65) Prior Publication Data

US 2014/0321898 A1 Oct. 30, 2014

Related U.S. Application Data

(63) Continuation of application No. PCT/EP2012/004985, filed on Dec. 3, 2012.

(30) Foreign Application Priority Data

Jan. 11, 2012 (CH) ..... 0053/12

(51) Int. Cl.

| | |
|---|---|
| ***B43K 23/08*** | (2006.01) |
| ***A45D 34/04*** | (2006.01) |
| ***A45D 33/12*** | (2006.01) |
| ***A45D 40/26*** | (2006.01) |

(52) U.S. Cl.

CPC ..... *A45D 34/041* (2013.01); *A45D 33/12* (2013.01); *A45D 40/261* (2013.01)

(58) Field of Classification Search

CPC ... A45D 34/041; A45D 40/261; A45D 33/12
USPC ..... 401/213, 216
See application file for complete search history.

(56) References Cited

U.S. PATENT DOCUMENTS 5,213,225 A * 5/1993 King ..... B65D 41/0471 215/214
6,814,520 B1 * 11/2004 Delli Venneri ..... A45D 34/041 401/209

(Continued)

FOREIGN PATENT DOCUMENTS

DE 202013000328 U1 * 1/2013 ..... A45D 34/041
EP 1 673 998 A1 6/2006

(Continued)

OTHER PUBLICATIONS

International Search Report (PCT/ISA/210) mailed on Jun. 19, 2013, by the European Patent Office as the International Searching Authority for International Application No. PCT/EP2012/004985.

(Continued)

*Primary Examiner* — Jennifer C Chiang
(74) *Attorney, Agent, or Firm* — Buchanan Ingersoll & Rooney PC

(57) ABSTRACT

A plastic container for a roll-on deodorant is described, which roll-on deodorant has a receptacle and a roll cage for the captive, rotatable holding of an applicator ball. The roll cage can be made integral with the receptacle. The plastic container can be produced in an extrusion-blow-molding method from a tube that is for example extruded continuously.

17 Claims, 1 Drawing Sheet

(56) References Cited

U.S. PATENT DOCUMENTS

| | | | | |
|---|---|---|---|---|
| 7,311,462 | B2 * | 12/2007 | Kervoalen | A45D 34/041 401/209 |
| 2002/0012565 | A1 | 1/2002 | Sirna et al. | |
| 2006/0165475 | A1 | 7/2006 | Kervoalen | |
| 2007/0071547 | A1 * | 3/2007 | Berrittella | A45D 34/041 403/122 |
| 2010/0180543 | A1 | 7/2010 | Arcuri Neto | |

FOREIGN PATENT DOCUMENTS

| | | | |
|---|---|---|---|
| WO | WO 00/64302 | A1 | 11/2000 |
| WO | WO 2009/006713 | A2 | 1/2009 |

OTHER PUBLICATIONS

Written Opinion (PCT/ISA/237) mailed on Jun. 19, 2013, by the European Patent Office as the International Searching Authority for International Application No. PCT/EP2012/004985.

* cited by examiner

PLASTIC CONTAINER FOR A ROLL-ON DEODORANT

RELATED APPLICATIONS

This application claims priority as a continuation application under 35 U.S.C. §120 to PCT/EP2012/004985, which was filed as an International Application on Dec. 3, 2012 designating the U.S., and which claims priority to Swiss Application 00053/12 filed in Switzerland on Jan. 11, 2012. The entire contents of these applications are hereby incorporated by reference in their entireties.

FIELD

The present disclosure relates to a plastic container for a roll-on deodorant.

BACKGROUND INFORMATION

Containers made of tin, or composite sheet metal, glass or else ceramic, known in the past, are being increasingly replaced by containers made of plastic. In the meantime, in particular for the packaging of fluid substances, for example beverages, household products, bodily care products, etc., plastic containers are now mainly being used. The low weight and the lower costs definitely play a significant role in this substitution. The use of recyclable plastic materials and the total energy balance that is more favorable as a whole in their production also contribute to promoting the acceptance of plastic containers, in particular plastic bottles, by consumers. Also, in the area of personal hygiene and cosmetics, the previously known glass containers are replaced to an increasing extent by those made of plastic.

To combat unpleasant body odor, for example from perspiration, recently so-called roll-on deodorants are being used more and more frequently. The roll-on deodorants are to replace in particular the previously used spray deodorants, whose propellants have in many cases proven disadvantageous for the ozone layer. A roll-on deodorant includes (e.g., consists of) a receptacle for a deodorant, which has a roll cage for an applicator ball on its upper area provided with the outlet opening. The ball is held in a rotatable manner in the cage. When the closure, such as a rotary closure, is screwed onto the receptacle, the ball presses against an annular circumferential sealing area and thus prevents leakage of the deodorant contained in the interior. When the closure is removed, a narrow gap remains between the ball surface and the sealing area. The gap makes it possible for the section of the ball that is wetted with the deodorant during the rotation of the ball to go to the part of the body to be treated, for example the armpit, and to release a thin film of deodorant there. Because of the dual function—on the one hand a seal, on the other hand, release of deodorant—relatively high specifications on the dimensional stability of the cage and the ball exist. The roll cages are therefore produced in an injection-molding method, which ensures the desired accuracies.

In the past, receptacles were in many cases manufactured from glass, onto which the injection-molded roll cage made of plastic was pressed or screwed. The applicator ball is pressed into the roll cage after the receptacle is filled with deodorant, and the ball can be rotated there and held captive. In the meantime, a number of roll-on deodorants are also known that have a receptacle made of plastic. In this case, the plastic container can be produced in a stretch blow-molding method or in an extrusion-blow-molding method.

In turn, the injection-molded roll cage is pressed or screwed onto the neck of the receptacle and, for example, in addition heat-sealed for fixing and sealing. The roll cage and the receptacle should have binding sections that are matched exactly to one another so that sealing problems can be avoided.

Known roll-on deodorants include (e.g., consist of) four components; the receptacle, the roll cage, the applicator ball, and the sealing cap, which are produced separately in each case and matched to one another with respect to dimensional stability. The logistical expense for the production, the storage and the merging of the components of the roll-on deodorant that are matched to one another can be significant. The production of the roll cage in the injection-molding method is relatively labor-intensive and costly because of the undercut for the rotation and at the same time captive holding device of the applicator ball. In this case, the tool costs for the injection-molding tool for the roll cage and the tool costs for the tool for the production of the receptacle play a significant role. Even a separate assembly and fixing of the roll cage on the plastic container is also desired, which increases the complexity and the costs for the production of roll-on deodorants.

SUMMARY

A plastic container is disclosed for a roll-on deodorant, comprising: a receptacle; and a roll cage for the captive, rotatable holding of an applicator ball, the roll cage being integral with the receptacle and produced as an extrusion-blow-molded plastic tube.

BRIEF DESCRIPTION OF THE DRAWINGS

Further advantages and features disclosed herein will follow from the subsequent description of exemplary embodiments with reference to the diagrammatic drawings. Here, in not-to-scale depiction.

In the figures, the same reference numbers in each case refer to the same components.

DETAILED DESCRIPTION

Figure 1:
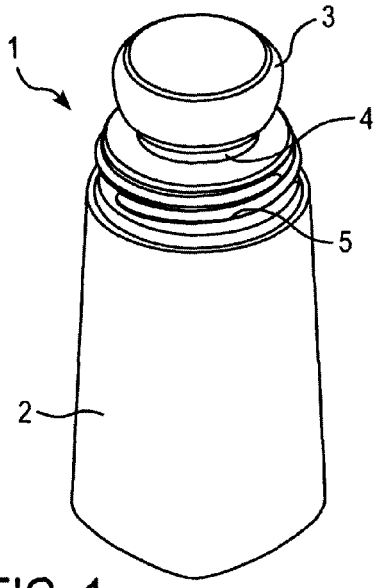
FIG. 1 shows a perspective depiction of a plastic container that is designed according to an exemplary embodiment with a receptacle and a roll cage that is molded-on in one piece.

Exemplary embodiments are disclosed which can reduce the complexity for the production, the storage and the merging of the individual components as well as for the assembly of roll-on deodorants. The tool costs can also be reduced.

An exemplary plastic container for a roll-on deodorant is disclosed, which has a receptacle and a roll cage for the captive rotatable holding of an applicator ball. The roll cage is made integral with the receptacle in an extrusion-blow-molding method from an extruded tube. As a result, separate tools for the production of the roll cage and for the production of the receptacle are no longer necessary. For the plastic containers that are made integral, only a single tool is necessary, which can be advantageous for tool costs.

By the roll cage being made integral with the receptacle for the deodorant, the assembly step for a separate roll cage is no longer necessary. Sealing problems of binding sections of the receptacle and the roll cage really cannot occur at all. The production of the plastic container is simplified by the integral design of the two sections of the plastic container, namely receptacle and roll cage. Complicated logistics for storage and properly-timed combining of two separately produced components for their assembly are no longer necessary.

The integral design can also increase degrees of freedom with respect to the configuration of the section of the plastic container that forms the receptacle and the section that is designed as a roll cage, since two separately-manufactured components do not have to be equipped with binding areas matched to one another.

The costs for the production of the plastic container for the roll-on deodorant can be also reduced because of the simplified production and the simplified handling. The production of the plastic container with a receptacle and roll cage made integral with one another in an extrusion-blow-molding method from an extruded plastic tube is very suitable and economical. The extrusion-blow-molding method, in which a single-layer or multi-layer plastic tube is extruded, is inserted into a blow mold and finally is blown in through a blow-molding medium introduced with overpressure according to the blow-mold cavity, is sufficiently tried and tested, can be implemented economically, and allows short production cycles.

The plastic container with a receptacle and roll cage that are made integral with one another can be blown in from a plastic tube that is extruded continuously or intermittently. The production of a continuously extruded plastic tube can be, for example used, because the units necessary for this purpose can be simpler in design. For example, in the continuous extrusion of the plastic tube, an accumulator head is no longer necessary.

For the special design of the roll cage that is molded-on in one piece and in which an applicator ball is to be held in a rotatable and captive manner, a variant of the extrusion-blow-molding method proves suitable, which is known as a "lost-head method." In this "lost-head method," an excess plastic section in vicinity of the roll cage is separated by cutting after the extrusion-blow-molding method. This can ensure that the section of the roll cage that is desired for the holding device of the applicator ball has the desired tolerances with respect to dimensional stability, wall thickness, and strength.

For the sealing, the roll cage that is molded-on in one piece can have an annular circumferential sealing area on a transition to the receptacle-forming section of the plastic container. In an exemplary variant embodiment, the roll cage can be provided at least in this sealing area with an inside layer that is softer than an outside layer of the roll cage. As a result, it can be ensured that the applicator ball that is inserted into the roll cage, which ball can include (e.g., consist of) a harder material, for example polypropylene, polyamide, polyethylene terephthalate (PET), etc., can produce an adequate seal when pressing against the sealing area of the roll cage. If the applicator ball is manufactured from, for example, polypropylene, the adjoining surface of the roll cage includes (e.g., consists of), for example, HDPE. In this case, the entire roll cage can be designed in one layer and can include (e.g., consist of) HDPE.

By the sealing area being designed as a circumferential annular collar, the contact between the applicator ball and the ring cage in the sealing area is approximately a line contact. As a result, even a relatively low pressing pressure is sufficient to achieve an adequate sealing. Owing to the design of a facet or the like in the sealing area, a flat seal can be achievable between the applicator ball and the ring cage.

Another exemplary variant embodiment provides that the plastic container in the area of the roll basket is designed in at least two layers. In this case, the inside layer of the roll cage is softer than its outside layer.

The inside layer of the roll cage can, for example, be advantageously produced by coextrusion. Coextrusion can be used for example in an extrusion-blow-molding method to produce multi-layer containers or objects. It can allow a very exact arrangement and metering of the additional layer(s) in order to set their wall thickness(es) exactly.

The inside layer of the roll cage suitably can, for example, have a hardness that is approximately 35 Shore to 90 Shore, according to ASTM test D-2240 (or according to ISO 868 or DIN53505). In the case of these hardness values for the inside layer, it can be ensured that the latter is softer in any case than the surface of the applicator balls used in roll-on deodorants.

As materials for the inside layer of the roll cage, for example, all plastics that are extrudable and expandable in a blow-molding process, for example polyolefins, thermoelastic elastomers, HDPE, LDPE, polyamides, copolymers as well as material mixtures containing the preceding material can be used. The hardness properties of the materials that are used can be set to the desired extent by adding softeners.

The plastic container can for example be suitably designed in multiple layers overall. For the outer layer, all plastics that are extrudable and expandable in a blow-molding process, for example, polyolefins, thermoelastic elastomers, HDPE, LDPE, polyamides, copolymers as well as material mixtures containing the preceding materials can be used. The hardness properties of the materials that are used can be set to the desired extent by adding softeners. The outer layer can have a greater hardness than the inside layer of the roll cage.

A roll-on deodorant is also provided, which roll-on deodorant can have a plastic container that is equipped according to the present disclosure, which has a roll cage made integral with the receptacle. An applicator ball can be mounted in a rotatable and captive manner within the roll cage. The roll-on deodorant can be a sealing cap whose height is sized in such a way that an extension projecting from an interior of a cover of the sealing cap presses against the applicator ball upon fastening to the plastic container and the latter seals the receptacle. Unlike roll-on deodorants of the state of the art, a roll-on deodorant as disclosed herein can have a smaller number of components, namely the plastic container with a receptacle section and roll cage section, the applicator ball, and the sealing cap. The roll-on deodorant can be simpler and more economical in its production.

The sealing cap of the roll-on deodorant can be suitably designed as a rotary closure. In this case, the rotary closure can be designed and configured in such a way that when the sealing cap is screwed on, an increased resistance must be overcome before the end position is reached. The increased resistance that must be overcome when screwing on the cap indicates to the user of the roll-on deodorant that he has adequately closed the roll-on deodorant. In this respect, the sealing cap and/or the plastic container can be suitably designed in such a way that to tightly close the plastic container with the sealing cap, a minimum torque of for example 30 Nm to 250 Nm, preferably for example 60 Nm to 140 Nm, must be applied. As an alternative, the sealing cap can also be connected to the plastic container via a bayonet closure.

A roll-on deodorant that contains a deodorant is also encompassed by the present disclosure.

Figure 2:
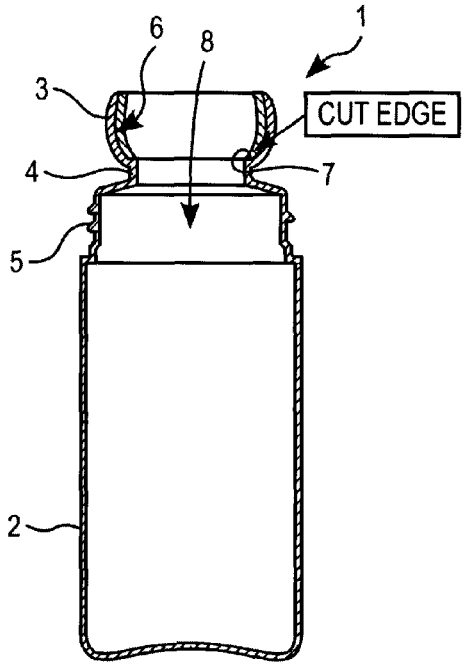
FIG. 2 shows an axial cutaway view of the exemplary plastic container of FIG. 1.
Figure 3:
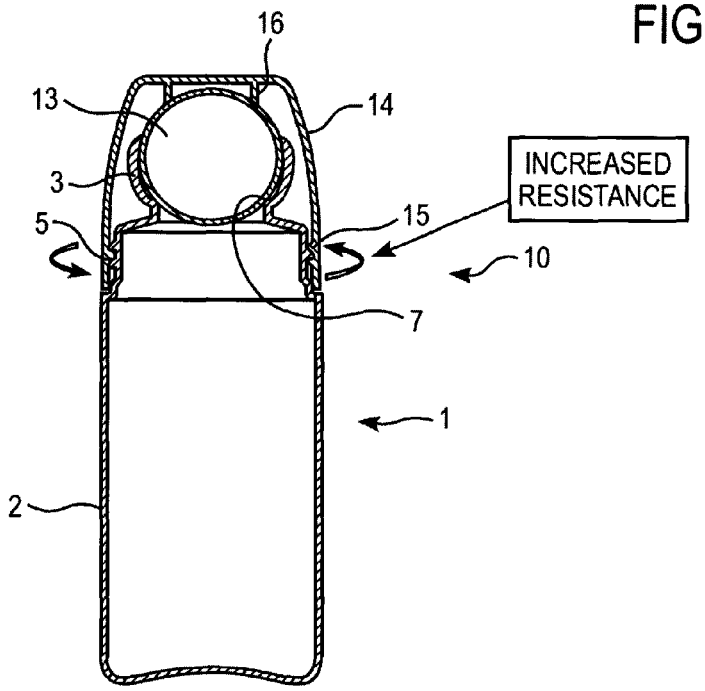
FIG. 3 shows an axial cutaway view of an exemplary assembled roll-on deodorant with a screwed-on sealing cap.

In the perspective view in FIG. 1 and the axial cutaway depiction in FIG. 2, an exemplary plastic container designed according to the present disclosure is in each case provided overall with the reference number 1. The plastic container 1 has a receptacle 2 and a roll cage 3 that is molded-on in one piece. The section that forms the receptacle 2 extends up to a tapering section 4. On the outside of the area of the receptacle 2 connecting to the tapering section 4, a thread 5 is formed. The roll cage 3 connects to the tapering section 4 and has a somewhat ball-section-shaped or toroidal outer contour. At the transition from the roll cage 3 to the tapering section 4, an annular circumferential collar 7 is formed on the inside wall 6 of the roll cage 3. The collar 7 borders an opening 8 in the receptacle 2 and forms a sealing area interacting with an applicator ball held in the roll cage 3 (FIG. 3).

The plastic container 1 with a receptacle 2 and roll cage 3 that are made integral is produced in an extrusion-blow-molding method. In this case, a single-layer or multi-layer plastic tube is for example continuously extruded, is inserted into a blow mold tool, and finally is blown in through a blow-molding medium introduced with overpressure according to the blow-mold cavity, and is demolded. In this case, the production of the roll cage 3 can be, for example, advantageously carried out in a so-called "lost-head method." In the "lost-head method," an excess plastic section in vicinity of the roll cage 3 is separated by cutting after the extrusion-blow-molding method. This can ensure that the section of the roll cage 3 that is used for the holding device of the applicator ball has the desired tolerances with respect to dimensional stability, wall thickness, and strength.

At least in the area of the annular circumferential collar 7, a layer that has less hardness than the applicator balls that can be used is provided on the inside wall of the roll cage. The entire roll cage 3 and optionally also the receptacle 2 suitably have an inside layer, which can be designed and configured to be softer than an outside layer of the plastic container 1. A hardness of the inside layer measured according to the ASTM standard D-2240 is for example approximately 35 Shore to 90 Shore.

As materials for the inside layer of the roll cage 3, for example, all plastics that are extrudable and expandable in a blow-molding process, for example polyolefins, thermoelastic elastomers, HDPE, LDPE, polyamides, copolymers as well as material mixtures containing the preceding materials can be used. The hardness properties of the materials that can be used can be set to the desired extent by adding softeners. The plastic container can be suitably and configured designed in multiple layers overall. For the outer layer, for example, all plastics that are extrudable and expandable in a blow-molding process, for example, polyolefins, thermoelastic elastomers, HDPE, LDPE, polyamides, copolymers as well as material mixtures containing the preceding materials can be used. The hardness properties of the materials that are used can be set to the desired extent by adding softeners. The outside layer can for example have a greater hardness than the inside layer of the roll cage 3.

FIG. 3 shows an axial cutaway depiction of an exemplary roll-on deodorant, which overall bears the reference number 10. Unlike the roll-on deodorants of the state of the art, which have four individual components, the roll-on deodorant 10 according to an exemplary embodiment can include (e.g., consist of) only three individual components, namely: the plastic container 1 with a receptacle 2 and roll cage 3 that are made integral, an applicator roll 13 which is held in a rotatable and captive manner in the roll cage 3, and a sealing cap 14, whose inside thread 15 interacts with the outside thread 5 of the plastic container 1. The plastic container 1 with a receptacle 2 and roll cage 3 that are made integral can be produced in an extrusion-blow-molding technology.

The sealing cap 14 that is designed as a rotary closure can have a height that is sized in such a way that an extension 16 projecting from an interior of a cover of the sealing cap 14 presses against the applicator ball 13 when the sealing cap 14 is screwed on. As a result, the applicator ball 13 is pressed against the annular circumferential collar 7, and the receptacle is sealed. The sealing is also supported in that the roll cage 3 has a surface or layer at least in the area of the annular circumferential collar 7 that is softer than the material of the applicator ball 13, which can include (e.g., consist of) a harder material, for example polypropylene, polyamide, polyethylene terephthalate, or a polyamide. In the interaction of the applicator ball 13 with the softer annular collar 7, the receptacle 2 is reliably sealed against an outflow of the content that is contained, for example a deodorant.

The plastic container 1 and/or the sealing cap 14 that is designed as a rotary closure can be designed and configured in such a way that when the sealing cap 14 is screwed on, an increased resistance must be overcome before the end position is reached. For example, in this respect, one or more areas that have an excess that must be overcome are provided at the end of the outside thread 5 and/or the inside thread 15. The user thus receives feedback that indicates to him that the roll-on deodorant is now closed in a correct and leak-proof manner. For example, a minimum torque of 30 Nm to 250 Nm, for example 60 Nm to 140 Nm, can be applied to overcome the increased resistance.

The invention is not limited to the described embodiments but rather also encompasses variant embodiments within the scope of the general ideas disclosed herein.

Thus, it will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

The invention claimed is:

1. A plastic container, comprising:

a receptacle wherein the receptacle includes a base on a bottom of the receptacle and configured to allow the container to rest in an upright position; and a roll cage configured for captive, rotatable holding of an applicator ball, the roll cage being integral with the receptacle and produced as an extrusion-blow-molded plastic tube, and an annular circumferential sealing area on a transition to the receptacle, wherein the roll cage at least in this sealing area has an inside layer that is softer than an outside layer of the roll cage.

2. The plastic container according to claim 1, wherein the receptacle and the roll cage are produced as one piece from a continuously extruded plastic tube.

3. The plastic container according to claim 2, wherein the receptacle and the roll cage molded in one piece include a cut edge due to separation of an excess plastic section in a vicinity of the roll cage by cutting after extrusion-blow-molding.

4. The plastic container according to claim 1, wherein the sealing area is a circumferential annular collar, or facet.

5. The plastic container according to claim 1, wherein the roll cage comprises:

at least two layers, whereby an inside layer of the roll cage is softer than an outside layer of the same.

6. The plastic container according to claim 5, wherein the inside layer is a coextrusion layer.

7. The plastic container according to claim 6, wherein the inside layer has a hardness that is approximately 35 Shore to 90 Shore.

8. The plastic container according to claim 7, wherein the inside layer comprises:

plastics that are extrudable and expandable in a blow-molding process, and selected from a group consisting of polyolefins, thermoelastic elastomers, HDPE, LDPE, polyamides, copolymers as well as material mixtures containing these materials, whose hardness properties can be set to a desired extent by adding softeners.

9. The plastic container according to claim 5, comprising:

multiple layers, whereby an outer layer includes a plastic material that is extrudable and expandable in a blow-molding process, whose hardness properties can be set by addition of softeners.

10. The plastic container according to claim 9, wherein the outer layer is harder than the inside layer of the roll cage.

11. A roll-on deodorant applicator comprising:

the plastic container with the roll cage that is integral with a receptacle and produced as an extrusion blow-molded plastic according to claim 1, in combination with:

an applicator ball, which is held in a rotatable and captive manner within the roll cage; and a sealing cap, whose height is sized such that an extension projecting from an interior of a cover of the sealing cap presses against the applicator ball upon fastening to the plastic container and the applicator ball seals the receptacle.

12. The roll-on deodorant applicator according to claim 11, wherein the sealing cap is a rotary closure, configured such that when the sealing cap is screwed onto the plastic container, an increased resistance must be overcome before an end position is reached.

13. The roll-on deodorant applicator according to claim 11, wherein the sealing cap and/or the plastic container is/are configured such that to tightly close the plastic container, a minimum torque of 30 Nm to 250 Nm must be applied.

14. The roll-on deodorant applicator according to claims 11 containing:

a deodorant.

15. The plastic container according to claim 1, wherein the inside layer is a coextrusion layer.

16. The plastic container according to claim 5, comprising:

multiple layers, whereby an outer layer includes a plastic material that is extrudable and expandable in a blow-molding process, whose hardness properties can be set by addition of softeners.

17. The roll-on deodorant applicator according to claim 11, wherein the sealing cap and/or the plastic container is/are configured such that to tightly close the plastic container, a minimum torque of 60 Nm to 140 Nm must be applied.

* * * * *